US008499581B2

(12) United States Patent
Shah et al.

(10) Patent No.: US 8,499,581 B2
(45) **Date of Patent: *Aug. 6, 2013**

(54) GAS CONDITIONING METHOD AND APPARATUS FOR THE RECOVERY OF LPG/NGL(C2+) FROM LNG

(75) Inventors: Kamal Shah, Sugar Land, TX (US); Girish Joshi, Sugar Land, TX (US)

(73) Assignee: IHI E&C International Corporation, Houston, TX (US)

( * ) Notice: Subject to any disclaimer, the term of this patent is extended or adjusted under 35 U.S.C. 154(b) by 1642 days.

This patent is subject to a terminal disclaimer.

(21) Appl. No.: 11/868,155

(22) Filed: Oct. 5, 2007

(65) Prior Publication Data

US 2008/0083246 A1 Apr. 10, 2008

Related U.S. Application Data

(60) Provisional application No. 60/849,783, filed on Oct. 6, 2006.

(51) Int. Cl.
*F25J 3/00* (2006.01)

(52) U.S. Cl.
USPC ..... 62/620; 62/618; 62/619; 62/621

(58) Field of Classification Search
USPC ..... 62/619, 620, 613, 612, 617, 618, 62/611
See application file for complete search history.

(56) References Cited

U.S. PATENT DOCUMENTS 2,437,909 A 3/1948 Cooper
3,230,967 A 1/1966 Castro (Continued)

FOREIGN PATENT DOCUMENTS

WO 0237041 A2 5/2002
WO 03095914 A1 11/2003
WO 2006004723 A1 1/2006

OTHER PUBLICATIONS

Wankat, P.C., et al., "Two-Feed Distillation: Same-Composition Feeds with Different Enthalpies", Ind. Eng. Chem. Res. ACS, 1993, vol. 32, No. 12, pp. 3061-3067.

*Primary Examiner* — Allen Flanigan
*Assistant Examiner* — Jason Thompson
(74) *Attorney, Agent, or Firm* — Rothwell, Figg, Ernst & Manbeck, P.C.

(57) ABSTRACT

A method and apparatus for conditioning imported liquefied natural gas to conform to a particular pipeline heating value specification and recovery of liquefied petroleum gas or natural gas liquids from liquefied natural gas are disclosed. An input stream containing liquefied natural gas is split into a direct stream and a bypass stream. The direct stream is heated in a cross-exchanger to produce a heated rich liquefied natural gas stream, which is split into a primary column feed and a secondary column feed. At least a major portion of the secondary column feed is vaporized to produce a vaporized secondary column feed, which is expanded in an expander to produce a vaporized and expanded secondary column feed. A top feed, the primary column feed, and the vaporized and expanded secondary column feed are fractionated to produce an overhead product stream and a bottom product stream. The overhead product stream is compressed in a compressor coupled to the expander. At least a major portion of the compressed overhead product stream is condensed by cooling in the cross-exchanger to produce a compressed and condensed overhead product stream. A reflux stream of at least one of the compressed and condensed overhead product stream or an output stream is directed to a top of the fractionation unit as the top feed. The bypass stream is mixed with a balance stream of the compressed and condensed overhead product stream to produce the output stream, which is vaporized to produce a conditioned natural gas product.

24 Claims, 4 Drawing Sheets

U.S. PATENT DOCUMENTS 3,367,122 A * 2/1968 Tutton ..... 62/630
3,657,895 A 4/1972 Phelps
3,675,431 A 7/1972 Jackson
3,698,198 A 10/1972 Phelps
3,727,418 A 4/1973 Glazier
3,745,773 A 7/1973 Cunningham
3,824,943 A 7/1974 Mo
3,899,988 A 8/1975 Menendez
3,984,059 A 10/1976 Davies
4,188,157 A 2/1980 Vigander
4,202,648 A 5/1980 Kvamsdal
4,209,267 A 6/1980 Gnaedinger
4,217,848 A 8/1980 Meyer-Haake
4,302,130 A 11/1981 Mo
4,314,776 A 2/1982 Palmer
4,365,576 A 12/1982 Cook
4,395,157 A 7/1983 Cunningham
4,404,988 A 9/1983 Trammell
4,422,804 A 12/1983 Gerwick, Jr. et al.
4,498,412 A 2/1985 Liden
4,535,639 A 8/1985 Bianchini
4,617,039 A * 10/1986 Buck ..... 62/621
5,114,451 A * 5/1992 Rambo et al. ..... 62/623
5,186,581 A 2/1993 Ngoc et al.
5,555,748 A 9/1996 Campbell et al.
5,682,750 A 11/1997 Preston
5,881,569 A 3/1999 Campbell et al.
5,904,910 A 5/1999 Stevens et al.
6,237,364 B1 5/2001 Stone
6,311,516 B1 * 11/2001 Key et al. ..... 62/619
6,360,545 B1 3/2002 Goldstone
6,367,286 B1 4/2002 Price
6,390,733 B1 5/2002 Burbage
6,405,561 B1 6/2002 Mortko et al.
6,510,706 B2 1/2003 Stone et al.
6,564,579 B1 5/2003 McCartney
6,564,580 B2 5/2003 Bowen et al.
6,604,380 B1 * 8/2003 Reddick et al. ..... 62/620
6,607,597 B2 * 8/2003 Sun et al. ..... 118/309
6,640,554 B2 11/2003 Emmer
6,915,662 B2 * 7/2005 Wilkinson et al. ..... 62/621
6,964,181 B1 11/2005 Milios et al.
7,069,743 B2 * 7/2006 Prim ..... 62/620
7,155,931 B2 1/2007 Wilkinson et al.
7,165,423 B2 1/2007 Winningham
7,216,507 B2 * 5/2007 Cuellar et al. ..... 62/620
2003/0005722 A1 * 1/2003 Wilkinson et al. ..... 62/613
2003/0014995 A1 * 1/2003 Bowen et al. ..... 62/623
2003/0158458 A1 * 8/2003 Prim ..... 585/800
2004/0045490 A1 3/2004 Goldbach
2004/0261395 A1 * 12/2004 Engdahl ..... 60/39.465
2005/0005636 A1 * 1/2005 Schroeder et al. ..... 62/620
2005/0061396 A1 3/2005 Landry et al.
2005/0066686 A1 * 3/2005 Wilkinson et al. ..... 62/620
2005/0155381 A1 * 7/2005 Yang et al. ..... 62/620
2006/0000234 A1 * 1/2006 Cuellar et al. ..... 62/620

* cited by examiner

GAS CONDITIONING METHOD AND APPARATUS FOR THE RECOVERY OF LPG/NGL(C2+) FROM LNG

CROSS REFERENCE TO RELATED APPLICATION

The present application claims the benefit of U.S. Provisional Patent Application No. 60/849,783, filed on Oct. 6, 2006, which is incorporated herein by this reference.

BACKGROUND OF THE INVENTION

1. Field of the Invention

This invention relates to the field of liquefied natural gas (LNG) gas conditioning processes, and in particular to the recovery of liquefied petroleum gas (LPG) containing propane and heavier components or natural gas liquids (NGL) containing ethane and heavier components ($C_{2+}$) from LNG.

2. Description of the Related Art

Natural gas is often produced at remote locations that are far from pipelines. An alternative to transporting natural gas through a pipeline is to liquefy the natural gas and transport it in special LNG tankers. An LNG handling and storage terminal is necessary to receive the imported liquefied natural gas and revaporize it for use. The re-vaporized natural gas may then be used as a gaseous fuel.

A typical LNG handling, storage and revaporization facility, such as the one shown in FIG. 1, may include an incoming stream of LNG 10, a ship vapor return blower 12, LNG storage and send out pumps 14, a boil off gas compression and condensation unit 16, LNG booster pumps 18, LNG vaporizers 20, and an outgoing stream to a natural gas pipeline 22.

Natural gas in general, and LNG in particular, is usually comprised mostly of methane ($C_1$). Natural gas may also, however, contain lesser amounts of heavier hydrocarbons such as ethane ($C_2$), propane ($C_3$), butanes ($C_4$) and the like, which are collectively known as $C_{2+}$, or ethane plus.

Natural gas shipped over a pipeline, for example, may need to conform to a particular specification for heating value. Since various hydrocarbons in the imported LNG have various heating values, it is often necessary to separate some or all of the heavier hydrocarbons from the methane in the LNG so that the gaseous fuel resulting from vaporizing the LNG has the right heating value. Furthermore, heavier hydrocarbons have a higher commercial value as liquid products (for use as petrochemical feed stocks, for example) than as fuel, and it is thus often desirable to separate the heavier hydrocarbons from the methane.

A heating value specified by a pipeline may change over time. Some of the customers of the pipeline may be satisfied with lean natural gas, while others may be willing to pay for higher heating values. A natural gas recovery system in which all incoming LNG passes through a single point of entry, or even a plurality of symmetrical points of entry, may be unable to blend heating values to suit various pipeline specifications.

There is a need in the art for an improved method and apparatus for recovery of liquefied petroleum gas or natural gas liquids from liquid natural gas.

SUMMARY OF THE INVENTION

In accordance with one embodiment a method for recovery of liquefied petroleum gas or natural gas liquids from liquefied natural gas comprises: splitting an input stream comprising substantially rich liquefied natural gas into a direct stream and a bypass stream, heating said direct stream in a cross-exchanger to produce a heated rich liquefied natural gas stream, splitting said heated rich liquefied natural gas stream into a primary column feed and a secondary column feed, vaporizing at least a major portion of said secondary column feed in a vaporizer to produce a vaporized secondary column feed, expanding said vaporized secondary column feed in an expander to produce a secondary column feed, fractionating a top feed, said primary column feed, and said vaporized and expanded secondary column feed in a fractionation unit to produce an overhead product stream and a bottom product stream, compressing said overhead product stream in a compressor which is coupled to said expander to produce a compressed overhead product stream, condensing at least a major portion of said compressed overhead product stream by cooling said compressed overhead product stream in said cross-exchanger to produce a compressed and condensed overhead product stream, directing part of it as a reflux stream of at least one of said compressed and condensed overhead product stream or an output stream to a top of said fractionation unit as said top feed, mixing said bypass stream with a balance stream of said compressed and condensed overhead product stream to produce said output stream, pumping and vaporizing said output stream to produce a conditioned natural gas suitable for delivery to a pipeline or for commercial use.

In a second aspect, an apparatus for recovery of liquefied petroleum gas or natural gas liquids from liquefied natural gas comprises: a fractionation unit for fractionating a top feed, a primary column feed, and a vaporized and expanded secondary column feed and producing an overhead product stream and a bottom product stream, a diverter for splitting an input stream comprising substantially rich liquefied natural gas into a direct stream and a bypass stream, a compressor for compressing said overhead product stream and producing a compressed overhead product stream, a cross-exchanger receiving said direct stream and heating said direct stream to produce a heated rich liquefied natural gas stream while condensing said compressed overhead product stream to produce a compressed and condensed overhead product stream, a diverter for splitting said heated rich liquefied natural gas stream into said primary column feed and a secondary column feed, a vaporizer for vaporizing said secondary column feed and producing a vaporized secondary column feed, an expander coupled to said compressor for expanding said vaporized secondary column feed and producing said vaporized and expanded secondary column feed, a diverter for directing a reflux stream of at least one of said condensed and compressed overhead product stream or an output stream to a top of said fractionation unit as said top feed, a mixer for mixing a bypass stream of said rich liquefied natural gas with a balance stream of said compressed and condensed overhead product stream to produce said output stream, and an output vaporizer for vaporizing said output stream to produce a conditioned natural gas suitable for delivery to a pipeline or for commercial use.

BRIEF DESCRIPTION OF THE SEVERAL VIEWS OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
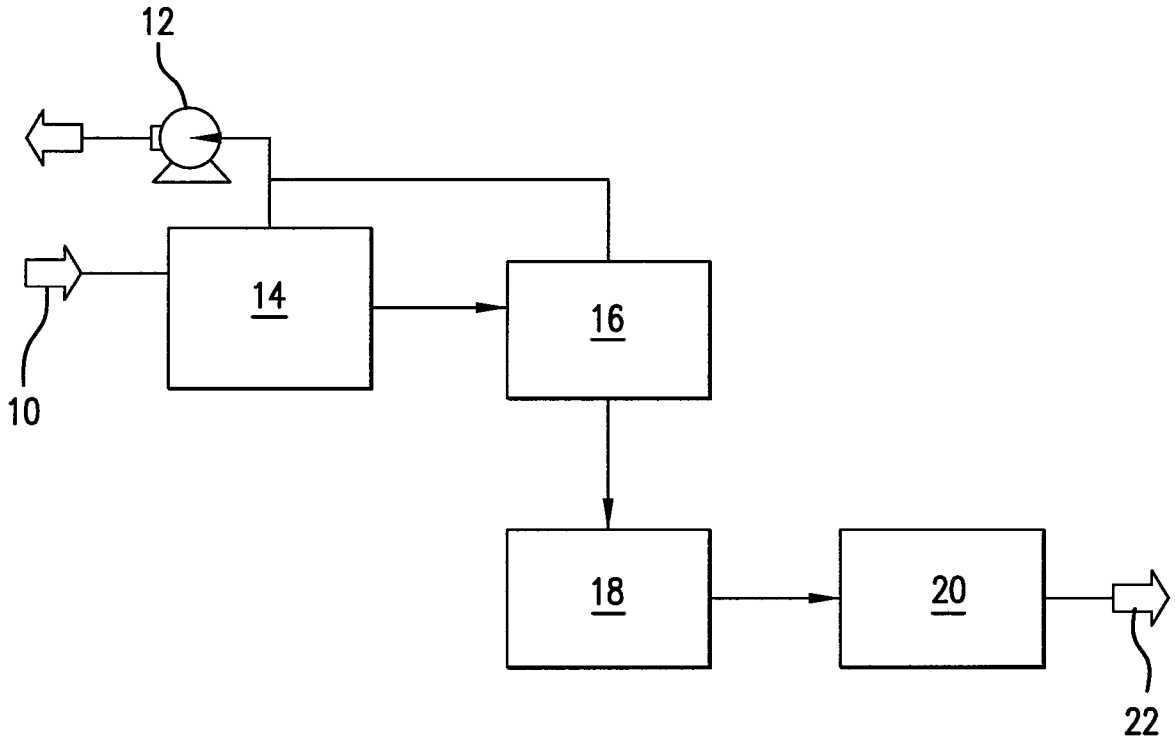
FIG. 1 PRIOR ART
FIG. 1 is a schematic diagram of a vaporization process according to a related art.
Figure 2:
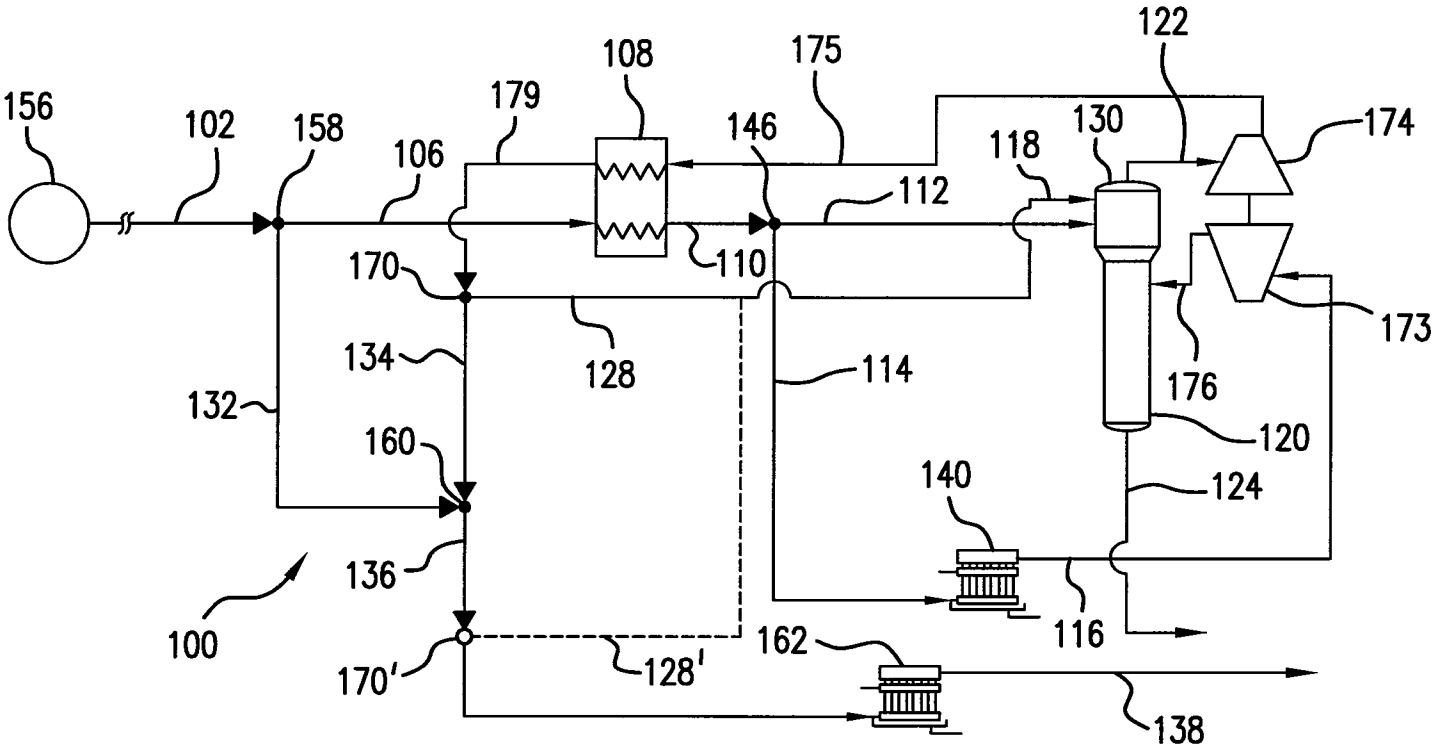
FIG. 2 is a schematic diagram of a gas conditioning apparatus according to a first embodiment of the invention.

In FIG. 2 is shown a gas conditioning process employing an apparatus 100 for recovery of liquefied petroleum gas or natural gas liquids from liquefied natural gas according to a first embodiment of the invention. An input stream 102 comprised substantially of rich liquefied natural gas may enter apparatus 100 from a source 156. In one embodiment, source 156 is an LNG booster pumps discharge. In this embodiment, input stream 102 may enter apparatus 100 at a temperature in a range of −235° F. to −250° F. In this embodiment, input stream 102 preferably may enter apparatus 100 at a temperature of about −245° F. In this embodiment, input stream 102 may enter apparatus 100 at a pressure in a range of 700 psig to 1100 psig. In this embodiment, input stream 102 preferably may enter apparatus 100 at a pressure of about 900 psig. In another embodiment, source 156 is a pipeline. In this embodiment, input stream 102 may enter apparatus 100 at a temperature in a range of −240° F. to −255° F. In this embodiment, input stream 102 preferably may enter apparatus 100 at a temperature of about −250° F. In this embodiment, input stream 102 may enter apparatus 100 at a pressure in a range of 75 psig to 100 psig. In this embodiment, input stream 102 preferably may enter apparatus 100 at a pressure of about 88 psig. In one embodiment, a pressure of input stream 102 may remain substantially constant or decrease slowly as it travels from source 156 to apparatus 100. In this embodiment, no pump or compressor is present between source 156 and apparatus 100 to compress the rich LNG or otherwise raise its pressure substantially. This may be useful if the particular LNG terminal at which apparatus 100 is installed has no pumping equipment available to raise the pressure of input stream 102 substantially. This may also reduce the capital equipment expenditure necessary to retro-fit apparatus 100 to an existing LNG terminal.

In one embodiment, a diverter 158 may split input stream 102 into a direct stream 106 and a bypass stream 132. In this embodiment, diverter 158 may be a variable diverter, such as a motorized valve applied to either the conduit carrying direct stream 106 or the conduit carrying bypass stream 132. A ratio between the amount of input stream 102 sent through the conduit carrying direct stream 106 or the conduit carrying bypass stream 132 may then be adjusted by opening or closing the appropriate valve in substantial proportion to the flow desired. Diverter 158 may thus allow apparatus 100 to produce a mix of conditioned, lean LNG with unconditioned rich LNG. Such mixing will in turn allow a range of mixtures and heating values of gas to be produced, from nearly pure rich LNG to nearly pure lean LNG. Apparatus 100 may thus be flexible in the heating values of gases it produces relative to conventional LNG vaporization systems that send all of the rich LNG through the process.

A cross-exchanger 108 may receive direct stream 106 from diverter 158. In several embodiments, cross-exchanger 108 may be an opposite-flow heat exchanger or a cross-flow heat exchanger. In one embodiment, a pressure of direct stream 106 may remain substantially constant or decrease slowly as it travels from diverter 158 to cross-exchanger 108. In this embodiment, no pump or compressor is present between diverter 158 and cross-exchanger 108 to compress direct stream 106 or otherwise raise its pressure substantially.

In one embodiment, direct stream 106 of input stream 102 may flow through cross-exchanger 108. Cross-exchanger 108 may heat direct stream 106 to produce a heated rich liquefied natural gas stream 110. In one embodiment, said direct stream 106 of said input stream 102 is heated by absorbing heat from said compressed overhead product stream 175. In one embodiment, cross-exchanger 108 heats direct stream 106 of pressurized input stream 180 to a temperature in a range of −125° F. to −132° F. In a preferable embodiment, cross-exchanger 108 heats direct stream 106 of input stream 102 to a temperature of about −129° F. In one embodiment, a diverter 146 may split heated rich liquefied natural gas stream 110 into two streams: a primary column feed 112 and a secondary column feed 114.

Apparatus 100 may fractionate propane and heavier compounds contained in the rich LNG and recover a large portion of the ethane. Apparatus 100 may include a fractionation unit 120 for this purpose. In one embodiment, fractionation unit 120 may be a demethanizer. In another embodiment, fractionation unit 120 may be a distillation unit. In several embodiments, fractionation unit 120 may be a trayed column having approximately thirty trays, a packed column, or a combination of a packed and a trayed column. In one embodiment, fractionation unit 120 may fractionate natural gas liquid containing ethane, propane and heavier components or liquefied petroleum gas containing propane and heavier components from methane and lighter components in the rich LNG.

In one embodiment, fractionation unit 120 may have three feed streams and two product streams. A top feed stream, i.e. top feed 118, may be a reflux stream 128 and be substantially all liquid. A middle feed stream, i.e. primary column feed 112, may be a primary feed stream. In one embodiment, primary column feed 112 may be comprised substantially of liquid. A bottom feed stream, i.e. vaporized and expanded secondary column feed 176, may be a secondary feed stream. In one embodiment, vaporized and expanded secondary column feed 176 may be substantially pre-heated.

In one embodiment, fractionation unit 120 fractionates natural gas liquid containing ethane, propane and heavier components from methane and lighter components in top feed 118, primary column feed 112, and vaporized and expanded secondary column feed 176 to produce an overhead product stream 122 and a bottom product stream 124. Overhead product stream 122 may contain mostly methane and lighter components. In one embodiment, overhead product stream 122 may be comprised substantially of vapor. In another embodiment, overhead product stream 122 may be mostly methane. In one embodiment, overhead product stream 122 may exit fractionation unit 120 at a temperature in a range of −145° F. to −155° F. In a preferable embodiment, overhead product stream 122 may exit fractionation unit 120 at a temperature of about −150° F. In one embodiment, overhead product stream 122 may exit fractionation unit 120 at a pressure in a range of 300 psig to 360 psig. In a preferable embodiment, overhead product stream 122 may exit fractionation unit 120 at a pressure of about 330 psig. In one embodiment, overhead product stream 122 may exit fractionation unit 120 at a pressure in a range of 250 psig to 450 psig.

In one embodiment, the NGL stream (i.e. bottom product stream 124) may contain mostly ethane, propane and heavier components. In one embodiment, bottom product stream 124 may be comprised substantially of natural gas liquids, such as $C_2$+ hydrocarbons. In one embodiment, bottom product stream 124 may be a mixture of ethane, propane and heavier components fractionated from the rich LNG. In one embodiment, bottom product stream 124 may exit fractionation unit 120 at a temperature in a range of 54° F. to 70° F. In a preferable embodiment, bottom product stream 124 may exit fractionation unit 120 at a temperature of about 62° F. In one embodiment, bottom product stream 124 may exit fractionation unit 120 at a pressure in a range of 305 psig to 365 psig. In a preferable embodiment, bottom product stream 124 may exit fractionation unit 120 at a pressure of about 335 psig. In another embodiment, bottom product stream 124 may exit fractionation unit 120 at a pressure in a range of 250 psig to 450 psig. In another embodiment, bottom product stream 124 may be controlled by heat input to fractionation unit 120 to meet natural gas liquid pipeline specifications.

Figure 3:
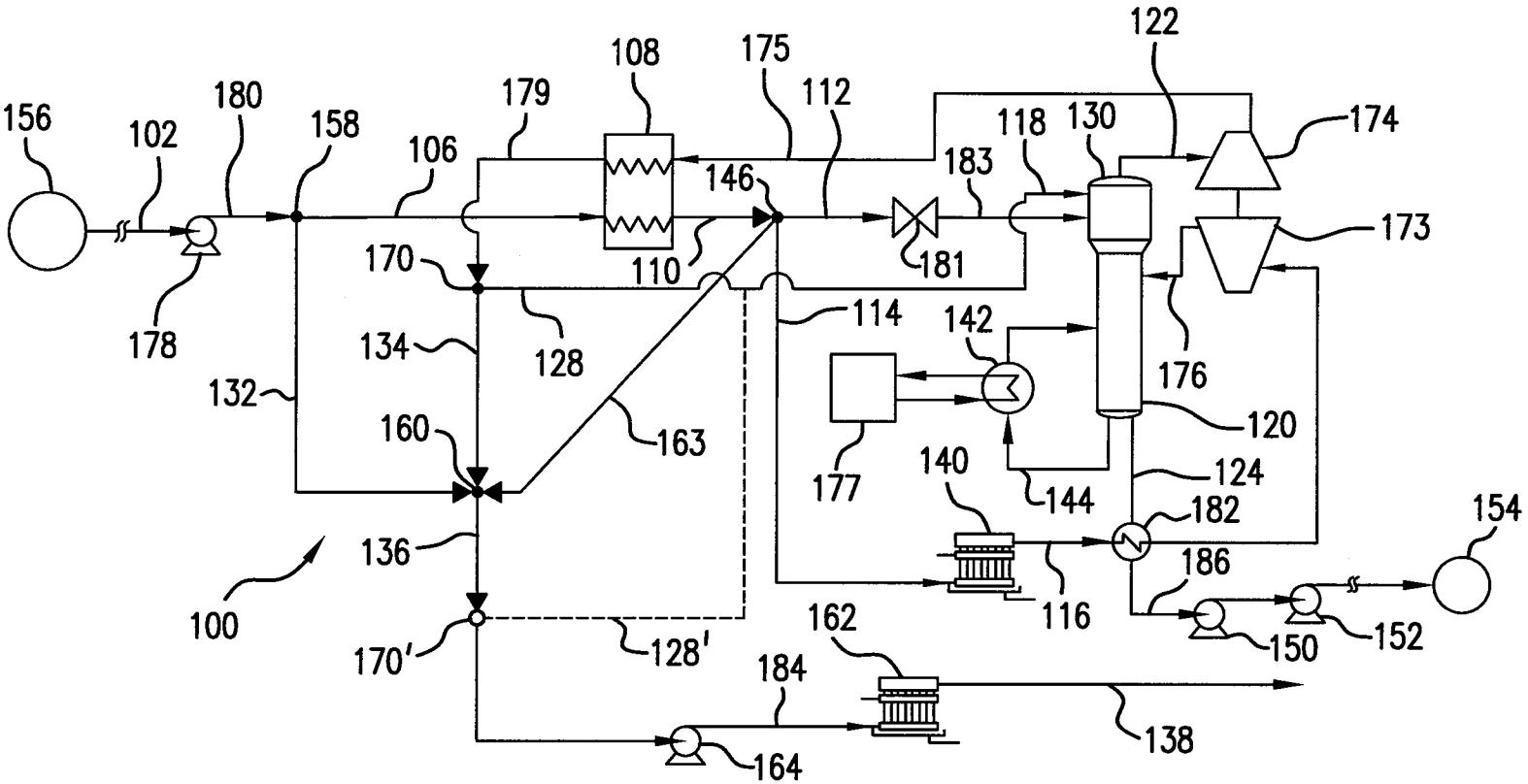
FIG. 3 is a schematic diagram of a gas conditioning apparatus according to alternate embodiments of the invention.

Primary column feed 112 may enter fractionation unit 120 directly at a temperature in a range of −140° F. to −150° F. Primary column feed 112 preferably may enter fractionation unit 120 directly at a temperature of about −145° F. Alternatively, primary column feed 112 may flow through a control valve that depressurizes the primary column feed, e.g., as shown in FIG. 3. Secondary column feed 114, on the other hand, may pass through a vaporizer 140 and be vaporized and then pass through an expander 173 and be expanded to a temperature in a range of −14° F. to −57° F. before entering fractionation unit 120. Secondary column feed 114 preferably may pass through a vaporizer 140 and be vaporized and then pass through an expander 173 and be expanded to about −35° F. before entering fractionation unit 120. In one embodiment, vaporizer 140 may vaporize at least a major portion of secondary column feed 114 and produce vaporized secondary column feed 116. In several embodiments, a heat source of vaporizer 140 may be seawater in the case of an open rack vaporizer, fuel gas in the case of a submerged combustion vaporizer, or an external heating medium in the case of an intermediate fluid vaporizer.

In one embodiment, expander 173 may expand vaporized secondary column feed 116 and produce vaporized and expanded secondary column feed 176. Expander 173 expands vaporized secondary column feed 116 to a pressure in a range of 300 psig to 370 psig. Expander 173 preferably expands vaporized secondary column feed 116 to a pressure of about 335 psig. The fractionation unit 120 may thus have lower operational pressure and therefore require lower heat input, reducing a re-boiler 142 duty of fractionation unit 120 (i.e., heating medium 177 temperature), and increasing the energy efficiency of the apparatus. In one embodiment, fractionation unit 120 may have an operational pressure in a range of 300 psig to 370 psig. In a preferred embodiment, fractionation unit may have an operational pressure of 335 psig. Apparatus 100 may also include a reboiler that adds heat to a bottom re-boil stream from fractionation unit 120, e.g., as shown in FIG. 3.

In one embodiment, compressor 174 is coupled to expander 173 and compresses overhead product stream 122 and produces compressed overhead product stream 175. By coupling compressor 174 to expander 173, expansion of vaporized secondary column feed 116 in expander 173 powers compressor 174, thereby reducing power consumption of the gas conditioning apparatus 100, while at the same time allowing fractionation unit 120 to have a lower operational pressure. In one embodiment, compressor 174 compresses overhead product stream 175 to a pressure in a range of 485 psig to 520 psig. In a preferred embodiment, compressor 174 compresses overhead product stream 175 to a pressure of about 503 psig.

Cross-exchanger 108 may condense at least a major portion of compressed overhead product stream 175 into lean LNG as well as preheat direct stream 106. Cross-exchanger 108 may condense compressed overhead product stream 175 by cooling compressed overhead product stream 175 to produce a compressed and condensed overhead product stream 179. In one embodiment, cross-exchanger 108 may cool compressed overhead product stream 175 by rejecting heat from compressed overhead product stream 175 to direct stream 106. In one embodiment, cross-exchanger 108 cools compressed overhead product stream 175 to a temperature in a range of −129° F. to −135° F. In a preferred embodiment, cross-exchanger 108 cools compressed overhead product stream 175 to a temperature of about −132° F.

In one embodiment, cross-exchanger 108 may heat direct stream 106 with heat absorbed from compressed overhead product stream 175 and produce heated rich liquefied natural gas stream 110. Preheating may reduce said re-boiler 142 duty of fractionation unit 120 (i.e., heating medium 177 temperature) and vaporizer 140 heat duty.

Part of the lean LNG coming from the cross-exchanger 108 may be returned to fractionation unit 120 as a reflux stream 128 by a diverter 170. In particular, diverter 170 may direct a reflux stream 128 of condensed and compressed overhead product stream 179 to a top section 130 of fractionation unit 120 as top feed 118. In one embodiment, diverter 170' may direct a reflux stream 128' of an output stream 136 to a top section 130 of a fractionation unit 120 as top feed 118. In one embodiment, reflux stream 128 may be comprised substantially of liquid. Reflux streams 128 or 128' may increase propane and heavier component recovery and reduce the amount of ethane removed in fractionation unit 120. Stream 128' allows additional recovery of propane and heavier component recovery from the bypass rich LNG stream.

In one embodiment, bypass stream 132 of input stream 102 from LNG booster pumps may bypass cross-exchanger 108 and mix with lean LNG coming from fractionation unit 120. In one embodiment, a mixer 160 may mix a bypass stream 132 of pressurized input stream 180 with a balance stream 134 of compressed and condensed overhead product stream 179 to produce output stream 136. An output vaporizer 162 may vaporize output stream 136 to produce a conditioned natural gas 138 suitable for delivery to a pipeline or for commercial use.

In FIG. 3 is shown an apparatus 100 for recovery of liquefied petroleum natural gas or natural gas liquids from liquefied natural gas according to alternate embodiments of the invention.

In one embodiment, a rich LNG booster pump 178 is present to raise the rich LNG pressure in the input stream to create a pressurized input stream 180. In one embodiment, pressurized input stream 180 may exit rich LNG booster pump 178 at a temperature in a range of −235° F. to −250° F. In a preferable embodiment, pressurized input stream 180 may exit rich LNG booster pump 178 at a temperature of about −245° F. In one embodiment, pressurized input stream 180 may exit rich LNG booster pump 178 at a pressure in a range of 700 psig to 1100 psig. In a preferable embodiment, pressurized input stream 180 may exit rich LNG booster pump 178 at a pressure of about 900 psig. In one embodiment, a diverter 158 may receive said pressurized input stream 180 and split said pressurized input stream into a direct stream 106 and a bypass stream 132.

In one embodiment, diverter 146 splits heated rich liquefied natural gas stream 110 into three streams: a primary column feed 112, a secondary column feed 114, and an optional bypass stream 163 which would connect to mixer 160. In this embodiment, mixer 160 mixes said optional bypass stream 163 with said balance portion 134 of said compressed and condensed overhead product stream 179 and said bypass stream 132 of said input stream 102 to produce said output stream 136.

In one embodiment, primary column feed 112 flows through a control valve 181. Control valve 181 may control the flow for the primary column feed 112 and the secondary column feed 114. Control valve 181 may depressurize primary column feed 112 to produce depressurized primary column feed 183. In one embodiment, control valve 181 depressurizes primary column feed 112 to a pressure in a range of 300 psig to 370 psig. In a preferable embodiment, control valve 181 depressurizes primary column feed 112 to a pressure of about 335 psig.

In one embodiment, apparatus 100 may include a re-boiler 142 adding heat to a bottom re-boil stream 144 from fractionation unit 120 and re-injecting bottom re-boil stream 144 into fractionation unit 120. In one embodiment, re-boiler 142 may be a submerged combustion vaporizer. In one embodiment, re-boiler 142 may be coupled to a heating medium 177. In one embodiment, re-boiler 142 has a low re-boil temperature. In one embodiment, re-boiler 142 is coupled to a low temperature heating medium. In one embodiment, said heating medium 177 comprises water. In one embodiment, said heating medium 177 comprises seawater.

In one embodiment, bottom product stream 124 and vaporized secondary column feed 116 flow through an exchanger 182. In one embodiment, exchanger 182 may cool bottom product stream 124 by rejecting heat from bottom product stream 124 to vaporized secondary column feed 116 and produce cooled bottom product stream 186. In one embodiment, exchanger 182 may recover heat from bottom product stream 124, direct the heat to vaporized secondary column feed 116, and reduce required heat input to the vaporizer 140.

In one embodiment, an output sendout pump 164 may pressurize output stream 136 to produce pressurized output stream 184. An output vaporizer 162 may vaporize pressurized output stream 184 to produce a conditioned natural gas 138 suitable for delivery to a pipeline or for commercial use.

In one embodiment, the NGL from fractionation unit 120 may be pumped by two pumps (a booster pump 150 and a high pressure pump 152) to NGL pipeline pressure and enter the NGL pipeline 154. Booster pump 150 may be used to provide the net positive suction head (NPSH) required by high pressure pump 152.

Part of the lean LNG coming from the cross-exchanger 108 may be returned to fractionation unit 120 as a reflux stream 128 by a diverter 170. In particular, diverter 170 may direct a reflux stream 128 of condensed and compressed overhead product stream 179 to a top section 130 of fractionation unit 120 as top feed 118. In one embodiment, diverter 170' may direct a reflux stream 128' of an output stream 136 to a top section 130 of a fractionation unit 120 as top feed 118. In one embodiment, reflux stream 128 may be comprised substantially of liquid. Reflux streams 128 or 128' may increase propane and heavier component recovery and reduce the amount of ethane removed in fractionation unit 120. Stream 128' allows additional recovery of propane and heavier component recovery from the bypass rich LNG stream.

In a second embodiment, a method for recovery of liquefied petroleum gas or natural gas liquids from liquefied natural gas, which may utilize apparatus 100, may include the steps of splitting an input stream 102 comprising substantially rich liquefied natural gas into a direct stream 106 and a bypass stream 132, heating said direct stream 106 in a cross-exchanger 108 to produce a heated rich liquefied natural gas stream 110, splitting said heated rich liquefied natural gas stream 110 into a primary column feed 112 and a secondary column feed 114, vaporizing at least a major portion of said secondary column feed 114 in a vaporizer 140 to produce a vaporized secondary column feed 116, expanding said vaporized secondary column feed in an expander 173 to produce a vaporized and expanded secondary column feed 176, fractionating a top feed 118, said primary column feed 112, and said vaporized and expanded secondary column feed 176 in a fractionation unit 120 to produce an overhead product stream 122 and a bottom product stream 124, compressing said overhead product stream 122 in a compressor 174 which is coupled to said expander 173 to produce a compressed overhead product stream 175, condensing at least a major portion of said compressed overhead product stream 175 by cooling said compressed overhead product stream 175 in said cross-exchanger 108 to produce a compressed and condensed overhead product stream 179, directing a reflux stream 128 of at least one of said compressed and condensed overhead product stream 179 or an output stream 136 to a top section 130 of said fractionation unit 120 as said top feed 118, mixing said bypass stream 132 with a balance stream 134 of said condensed and compressed overhead product stream 179 to produce said output stream 136, and vaporizing said output stream 136 to produce a conditioned natural gas 138 suitable for delivery to a pipeline or for commercial use.

In a third embodiment, an apparatus 100 for recovery of liquefied petroleum gas or natural gas liquids from liquefied natural gas comprises: a fractionation unit 120 for fractionating a top feed 118, a primary column feed 112, and an expanded and vaporized secondary column feed 176 and producing an overhead product stream 122 and a bottom product stream 124, a diverter 158 for splitting an input stream 102 comprising substantially rich liquefied natural gas into a direct stream 106 and a bypass stream 132, a compressor 174 for compressing said overhead product stream 122 and producing a compressed overhead product stream 175, a cross-exchanger 108 receiving said direct stream 106 and heating said direct stream 106 to produce a heated rich liquefied natural gas stream 110 while condensing at least a major portion of said compressed overhead product stream 175 to produce a compressed and condensed overhead product stream 179, a diverter 146 for splitting said heated rich liquefied natural gas stream 110 into said primary column feed 112 and a secondary column feed 114, a vaporizer 140 for vaporizing at least a major portion of said secondary column feed 114 and producing a vaporized secondary column feed 116, an expander 173 coupled to said compressor 174 for expanding said vaporized secondary column feed 116 and producing said vaporized and expanded secondary column feed 176, a diverter 170 for directing a reflux stream 128 of at least one of said compressed and condensed overhead product stream 179 or diverter 170' for directing a reflux stream 128' from an output stream 136 to a top section 130 of said fractionation unit 120 as said top feed 118, a mixer 160 for mixing a bypass stream 132 of said rich liquefied natural gas with a balance stream 134 of said compressed and condensed overhead product stream 179 to produce said output stream 136, and an output vaporizer 162 for vaporizing said output stream 136 to produce a conditioned natural gas 138 suitable for delivery to a pipeline or for commercial use.

Figure 4:
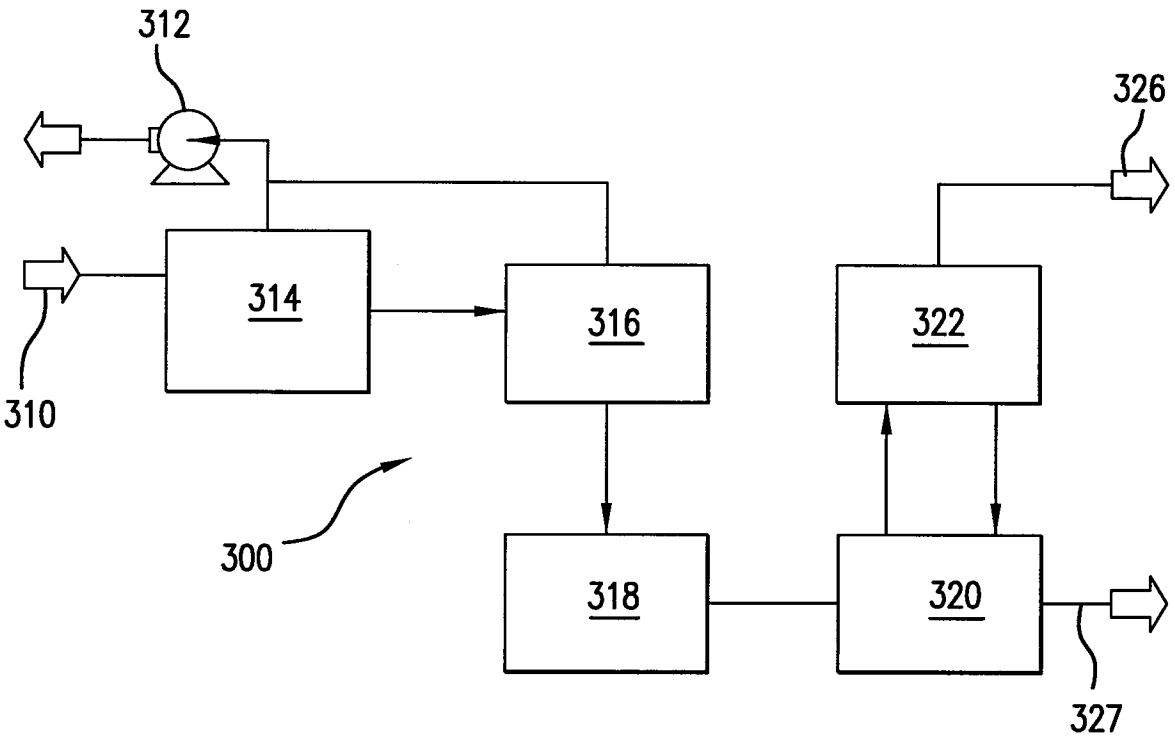
FIG. 4 is a schematic diagram of an LNG handling and storage facility according to an embodiment of the invention.

In FIG. 4 is shown an LNG handling and storage facility 300 according to a fifth embodiment of the invention. LNG handling and storage facility 300 may include an incoming stream of LNG 310, a ship vapor return blower 312, LNG storage and send out pumps 314, a boil off gas compression and condensation unit 316, LNG booster pumps 318, LNG vaporizers 320 providing heat for gas conditioning unit and vaporizing lean LNG to produce conditioned natural gas stream 327 suitable for delivery to a natural gas pipeline, gas conditioning process 322 for recovery of liquefied petroleum gas or natural gas liquids from liquefied natural gas, and an outgoing stream of NGL or LPG to a liquid product pipeline 326.

In one embodiment, expander 173 expands the vaporized secondary column feed, provides power required to compress overhead product stream 122, and keeps fractionation unit 120 operational pressure lower. The lower fractionation unit 120 operational pressure has two advantages: apparatus 100 may use a low temperature re-boiler 142 heat input that may be available from seawater, cooling tower water etc. reducing or eliminating the steam or higher temperature heat requirement, and attendant fuel. The fractionation unit 120 design pressure being lower also reduces equipment cost.

The above novel processes, methods, and apparatuses are distinctly different from other processes that demand an electric power requirement on the order of 10,000 HP to drive a compressor needed to compress flashed gas or demethanizer overhead gas in these processes for a 1 BSCFD gas facility. Several embodiments presented above may reduce overall power consumption to about 2500 HP or less, saving the overall power requirements by about 75% or more.

The foregoing has described the principles, embodiments, and modes of operation of the present invention. However, the invention should not be construed as being limited to the particular embodiments described above, as they should be regarded as being illustrative and not restrictive. It should be appreciated that variations may be made in those embodiments by those skilled in the art without departing from the scope of the present invention.

While the invention has been described in detail above, the invention is not intended to be limited to the specific embodiments as described. It is evident that those skilled in the art may now make numerous uses and modifications of and departures from the specific embodiments described herein without departing from the inventive concepts.

While various embodiments of the present invention have been described above, they should be understood to have been presented by way of examples only, and not limitation. Thus, the breadth and scope of the present invention should not be limited by the above described embodiments.

Numerous modifications and variations of the present invention are possible in light of the above teachings. It is therefore to be understood that the invention may be practiced otherwise than as specifically described herein.

What is claimed is:

1. A method for recovery of liquefied petroleum gas or natural gas liquids from liquefied natural gas, the method comprising: splitting an input stream comprising substantially rich liquefied natural gas into a direct stream and a bypass stream; heating said direct stream in a cross-exchanger to produce a heated rich liquefied natural gas stream; splitting said heated rich liquefied natural gas into a primary column feed and a secondary column feed; vaporizing at least a major portion of said secondary column feed in a vaporizer to produce a vaporized secondary column feed; expanding said vaporized secondary column feed in an expander to produce a vaporized and expanded secondary column feed; fractionating a top feed, said primary column feed, and said vaporized and expanded secondary column feed in a fractionation unit to produce an overhead product stream and a bottom product stream; compressing said overhead product stream in a compressor which is coupled to said expander to produce a compressed overhead product stream; condensing at least a major portion of said compressed overhead product stream by cooling said compressed overhead product stream in said cross-exchanger to produce a compressed and condensed overhead product stream; directing a reflux stream comprising a part of both of said compressed and condensed overhead product stream and an output stream to a top of said fractionation unit as said top feed; mixing said bypass stream with a balance stream of said compressed and condensed overhead product stream to produce said output stream; and vaporizing said output stream to produce a conditioned natural gas suitable for delivery to a pipeline or for commercial use.

2. The method of claim 1, comprising further:

diverting a portion of said heated rich liquefied natural gas stream into an optional bypass stream; and mixing said optional bypass stream with said balance portion of said compressed and condensed overhead product stream and said bypass stream of said input stream to produce said output stream.

3. The method of claim 1, comprising further: depressurizing said primary column feed with a control valve to produce a depressurized primary column feed.

4. The method of claim 1, wherein said expander expands said vaporized secondary column feed to a pressure in a range of 300 psig to 370 psig.

5. The method of claim 3, wherein said control valve depressurizes said primary column feed to a pressure in a range of 300 psig to 370 psig.

6. The method of claim 1, wherein said compressor compresses said overhead product stream to a pressure in a range of 485 psig to 520 psig.

7. The method of claim 1, wherein said fractionation unit has an operational pressure in a range of 300 psig to 370 psig.

8. The method of claim 1, further comprising adding heat to a bottom re-boil stream from said fractionation unit and re-injecting said bottom re-boil stream into said fractionation unit with a re-boiler.

9. The method of claim 8, wherein said re-boiler has a low re-boil temperature.

10. The method of claim 9, wherein said re-boiler is coupled to a low temperature heating medium.

11. The method of claim 10, wherein said heating medium comprises water.

12. The method of claim 11, wherein said heating medium comprises seawater.

13. An apparatus for recovery of liquefied petroleum gas or natural gas liquids from liquefied natural gas, comprising: a fractionation unit for fractionating a top feed, a primary column feed, and a vaporized and expanded secondary column feed and producing an overhead product stream and a bottom product stream; a diverter for splitting an input stream comprising substantially rich liquefied natural gas into a direct stream and a bypass stream; a compressor for compressing said overhead product stream and producing a compressed overhead product stream; a cross-exchanger receiving said direct stream and heating said direct stream to produce a heated rich liquefied natural gas stream while condensing at least a major portion of said compressed overhead product stream to produce a compressed and condensed overhead product stream; a diverter for splitting said heated rich liquefied natural gas into said primary column feed and a secondary column feed; a vaporizer for vaporizing at least a major portion of said secondary column feed and producing a vaporized secondary column feed; an expander coupled to said compressor for expanding said vaporized secondary column feed and producing said vaporized and expanded secondary column feed; a first diverter and a second diverter, said first diverter for directing a reflux stream comprising a part of said compressed and condensed overhead product stream to a top of said fractionation unit as said top feed and said second diverter for directing a reflux stream comprising a part of an output stream to said top of said fractionation unit as said top feed; a mixer for mixing a bypass stream of said rich liquefied natural gas with a balance stream of said compressed and condensed overhead product stream to produce said output stream; and an output vaporizer for vaporizing said output stream to produce a conditioned natural gas suitable for delivery to a pipeline or for commercial use.

14. The apparatus of claim 13, wherein: said diverter diverts a portion of said heated rich liquefied natural gas stream into an optional bypass stream; and said mixer mixes said optional bypass stream with said balance portion of said condensed and compressed overhead product stream and said bypass stream of said input stream to produce an output stream.

15. The apparatus of claim 13, further comprising: a control valve for depressurizing said primary column feed to produce a depressurized primary column feed.

16. The apparatus of claim 13, wherein said expander expands said vaporized secondary column feed to a pressure in a range of 300 psig to 370 psig.

17. The apparatus of claim 15, wherein said control valve depressurizes said primary column feed to a pressure in a range of 300 psig to 370 psig.

18. The apparatus of claim 13, wherein said compressor compresses said overhead product stream to a pressure in a range of 485 psig to 520 psig.

19. The apparatus of claim 13, wherein said fractionation unit has an operational pressure in a range of 300 psig to 370 psig.

20. The apparatus of claim 13, comprising further a re-boiler adding heat to a bottom re-boil stream from said fractionation unit and re-injecting said bottom re-boil stream into said fractionation unit.

21. The apparatus of claim 20, wherein said re-boiler has a low re-boil temperature.

22. The apparatus of claim 21, wherein said re-boiler is coupled to a low temperature heating medium.

23. The apparatus of claim 22, wherein said heating medium comprises water.

24. The apparatus of claim 23, wherein said heating medium comprises seawater.

* * * * *